US007665997B1

(12) United States Patent
Lin

(10) Patent No.: US 7,665,997 B1
(45) Date of Patent: Feb. 23, 2010

(54) ROTATABLE ELECTRIC PLUG

(75) Inventor: Chien-Tang Lin, Fongyuan (TW)

(73) Assignee: GME Technology Co., Ltd., Taichung Hsien (TW)

( * ) Notice: Subject to any disclaimer, the term of this patent is extended or adjusted under 35 U.S.C. 154(b) by 0 days.

(21) Appl. No.: 12/269,223

(22) Filed: Nov. 12, 2008

(51) Int. Cl.
*H01R 39/00* (2006.01)

(52) U.S. Cl. ..... 439/22; 439/13; 439/518

(58) Field of Classification Search ..... 439/171–175, 439/640, 13, 22, 27, 518
See application file for complete search history.

(56) References Cited

U.S. PATENT DOCUMENTS 6,923,667 B1 8/2005 Chen
7,125,257 B1 * 10/2006 Liang ..... 439/22
7,381,059 B2 * 6/2008 Wong ..... 439/22
7,462,074 B1 12/2008 Devlin et al.

FOREIGN PATENT DOCUMENTS

EP 1562270 8/2005
EP 1619763 1/2006
WO WO 2008/108739 9/2008

* cited by examiner

*Primary Examiner*—Javaid Nasri
(74) *Attorney, Agent, or Firm*—Rabin & Berdo, P.C.

(57) ABSTRACT

A rotatable electric plug has a bottom case, a rotatable brace, a plug head, a limit cover and a top cover. The rotatable brace is rotatably mounted in the bottom case and has a top surface and two connectors being mounted on the top surface of the rotatable brace. The plug head is detachably mounted on the bottom case and is connected with the rotatable brace. Two pins of the plug head is electronically connected to the connectors respectively. The limit cover is mounted in the bottom case to position the rotatable brace. The top cover is mounted on the bottom case to hold the rotatable brace and the limit cover inside the bottom case.

10 Claims, 4 Drawing Sheets

ROTATABLE ELECTRIC PLUG

BACKGROUND OF THE INVENTION

1. Field of Invention

The present invention relates to an electric plug, and more particularly to a rotatable electric plug.

2. Description of the Related Art

Electrical devices are necessary for everyone's daily life. Specifications of electric plugs are different in different countries. In order to use an electrical device having an impropriety plug in some specific countries, an adapter for specific plugs or to replace the plug with a suitable one is necessary. However, neither using a specific adapter nor replacing the plug directly is ease since the adapter is easily detached from the plug and replacement is troublesome. Moreover, the adapter normally has a large volume and is not able to adjust the orientation on a socket, so that the adapter may cover adjacent sockets to cause that the sockets cannot be used.

The present invention provides a rotatable electric plug to obviate or mitigate the shortcomings of the conventional electric plug.

SUMMARY OF THE INVENTION

The primary objective of the present invention is to provide a rotatable electric device that is easy to replace different plug heads and is capable of rotating the plug dead to increase convenience in use.

The rotatable electric plug has a bottom case, a rotatable brace, a plug head, a limit cover, and a top cover. The rotatable brace is rotatably mounted in the bottom case and has a top surface and two connectors being mounted on the top surface of the rotatable brace. The plug head is detachably mounted on the bottom case and is connected with the rotatable brace. Two pins of the plug head is electronically connected to the connectors respectively. The limit cover is mounted in the bottom case to position the rotatable brace. The top cover is mounted on the bottom case to hold the rotatable brace and the limit cover inside the bottom case.

Other objectives, advantages and novel features of the invention will become more apparent from the following detailed description when taken in conjunction with the accompanying drawings.

DETAILED DESCRIPTION OF THE INVENTION

Figure 1:
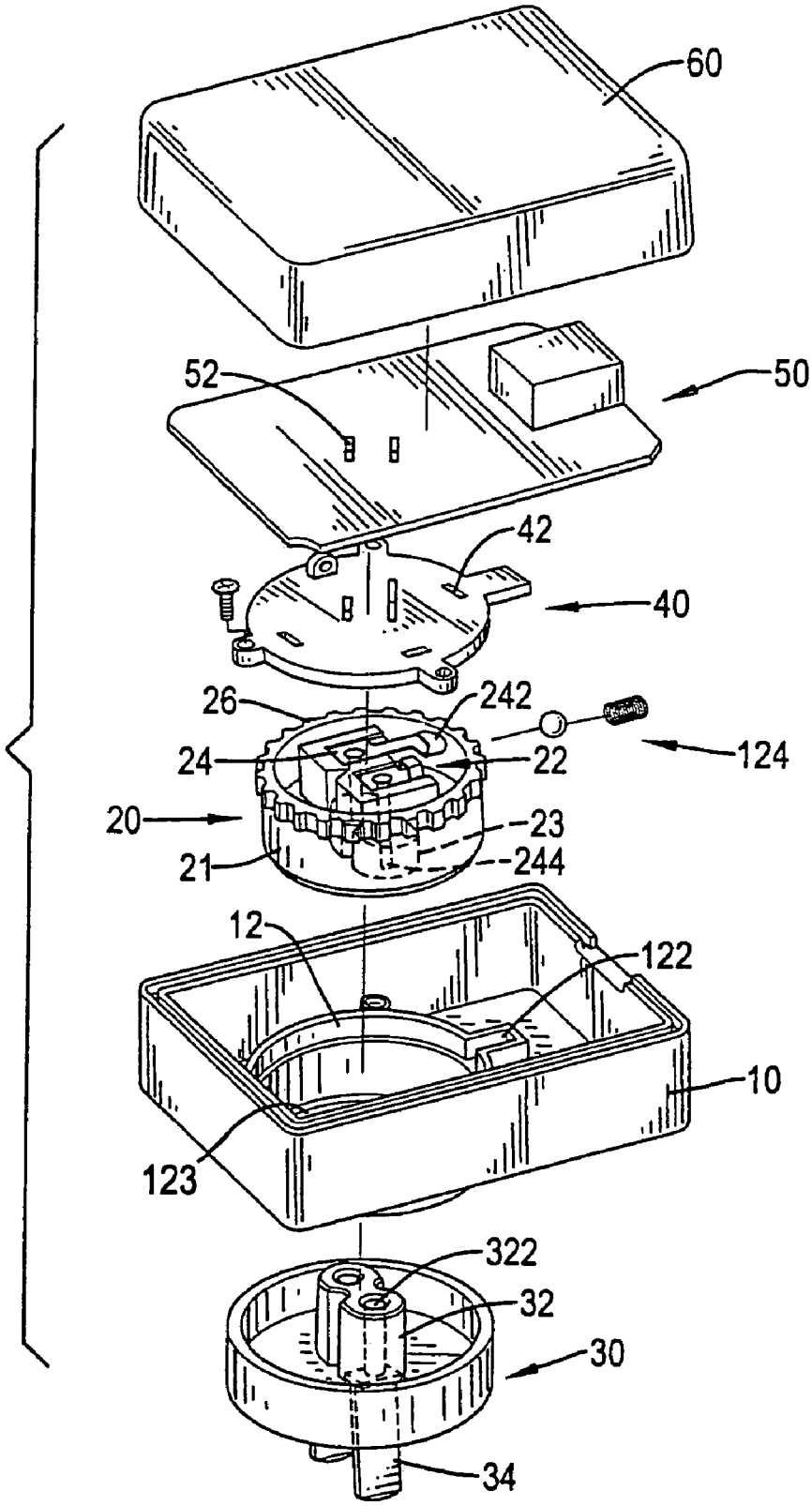
FIG. 1 is an exploded perspective view of a rotatable electric plug in accordance of the present invention.
Figure 2:
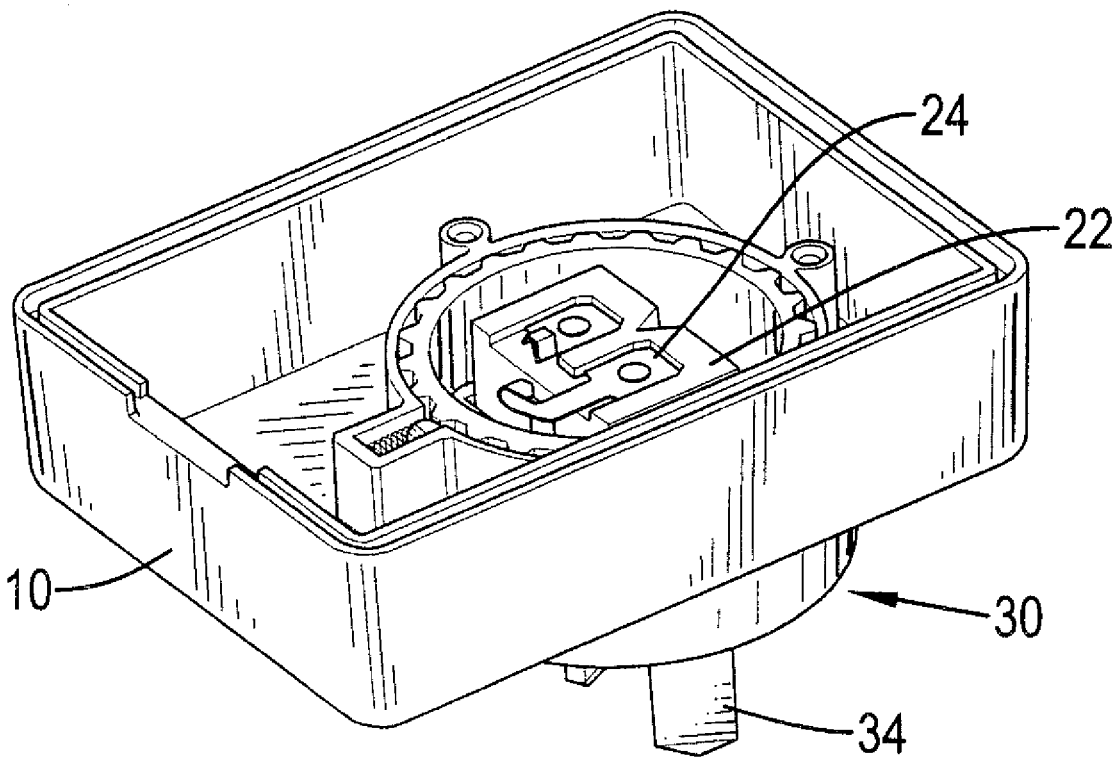
FIG. 2 is a perspective view of the rotatable electric plug in accordance with the present invention.

With reference to FIGS. 1 and 2, a rotatable electric plug in accordance with the present invention comprises a bottom case (10), a rotatable brace (20), a plug head (30), a limit cover (40), an optional circuit board (50) and a top cover (60).

The bottom case (10) may be rectangular and has a bottom surface, a top surface, an opening and a tube (12). The opening is formed through the top surface of the bottom case (10). The tube (12) is hollow, is formed through the bottom surface of the bottom case (10) and has a top end, a lower end, an inner surface, an optional mount recess (122) and an optional positioning assembly (124). The lower end protrudes from the bottom surface of the bottom case (10). The inner surface may be tapered or may have an annular flange (123) formed adjacent to the lower end of the rotating tube (12).

The mount recess (122) is formed in the inner surface of the rotating tube (12). The positioning assembly (124) is mounted in the mount recess (122) and has a resilient element and a positioning element. The resilient element may be a spring and is mounted in the mount recess (122). The positioning element may be a ball and abuts against with the resilient element. The positioning element slightly protrudes from the inner surface after the positioning assembly (124) is mounted in the mount recess (122).

The rotatable brace (20) is rotatably mounted in the inner surface of the tube (12), is supported in the tube (12) by the tapered shape of the tube (12) or on the annular flange (123) and has a brace body (21), a stand (22), two connectors (24) and an optional positioning ring (26).

The brace body (21) has a shape corresponding to and is movably surrounded by the inner surface of the tube (12) and has a brace annular surface.

The stand (22) is formed on the brace body (21) and has a top end, a bottom end, a mounting hole (23) and a top surface. The bottom end of the stand (22) is formed through the brace body (21). The mounting hole (23) is coaxially formed through the stand (22) from the top end through the bottom end. The top surface has two contact holes being formed therethrough, the contact holes are communicated with the mounting hole of the stand (22).

The connectors (24) are electronically conductible, are respectively and separately mounted on the top surface of the stand (22) and correspond respectively to the two contact holes of the top surface of the stand (22). Each connector (24) has a contact arm (242) and a connecting pin (244). The contact arm (242) is electronically conductible, protruding from the connector (24) radially toward the brace annular surface of the brace body (21) and has a distal contact end. In addition, the contact arms (242) of the two connectors (24) have different lengths so that the distal contact ends of the contact arms (242) have different passing routes (i.e. the passing routes having different radiuses) when the brace body (21) is rotated inside the inner surface of the tube (12). Each distal contact end may be a bent segment being formed on a corresponding contact arm (242).

The connecting pins (244) are electronically conductible, respectively protrude from the connectors (24), are respectively mounted through the contact holes and are placed parallelly inside the mounting hole (23).

The positioning ring (26) is circularly mounted around the brace annular surface of the brace body (21), is positioned corresponding to the mount recess (122) after the rotatable brace (20) is mounted in the tube (12) and has an annular surface and multiple positioning recesses. The positioning recesses of the positioning ring (26) are separately formed in the annular surface of the positioning ring (26). The positioning element of the positioning assembly (124) selectively engages one of the positioning recesses in the positioning ring (26) to hold the rotatable brace (20) at a specific position in the tube (12).

The plug head (30) is detachably and rotatably mounted on the lower end of the tube (12) and has an extending tube (32) and two plug pins (34). The extending tube (32) has a shape corresponding to and is detachably mounted in the mounting hole (23) of the stand (22) from the bottom end of the stand (22) to a position adjacent to the top end of the stand (22). The extending tube (32) has two plug holes (322). The plug holes (322) are longitudinally and separately formed through the extending tube (32) and are respectively aligned with the two contact holes of the stand (22). Each plug hole (322) may have an electronically conductible inner surface, where the electronically conductible inner surface electronically and detachably mounts on one connecting pin (244). The electronically conductible inner surface may be elastic metal tube thereby mounts on the connecting pin (244) securely to provide a well conduction between the connecting pin (244) and the electronically conductible inner surface.

The plug pins (34) are metal, are electronically conductible, are respectively mounted in the plug holes (322) and are respectively and electronically connected to the two the electronically conductible inner surface of the plug holes (322).

Figure 3C:
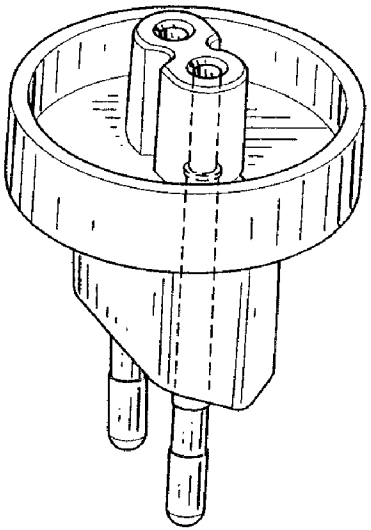
FIGS. 3A to 3C are perspective views of three different replaceable plug heads of the rotatable electric plug in FIG. 1.
Figure 3B:
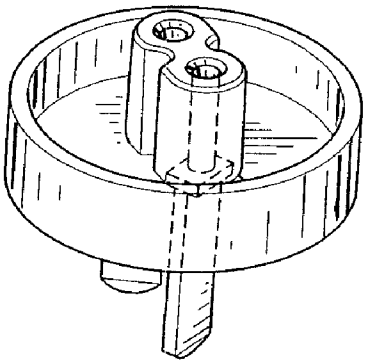
Figure 3A:
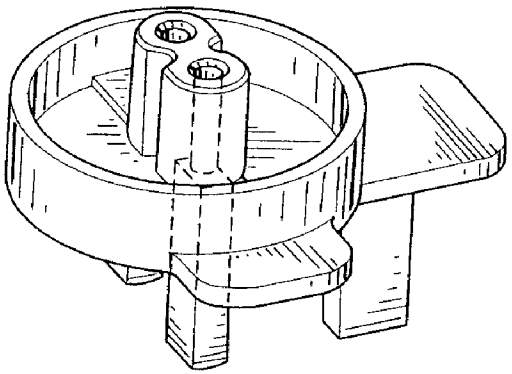

Moreover, the shapes, sizes and distances of the plug pins (34) are not limited but depended on specifications of different counties. FIGS. 3A to 3C show three different plug heads (30) having different plug pins (34) that are respectively suitable for United Kingdom, Australia and America.

The limit cover (40) has a shape corresponding to and is mounted on the top end of the tube (12) to limit the rotatable brace (20) in the tube (12). The limit cover (40) has two connecting holes (42) and two conducting members (44). The two connecting holes (42) are respectively formed through the limit cover (40) and correspond to the connectors (24).

Figure 4:
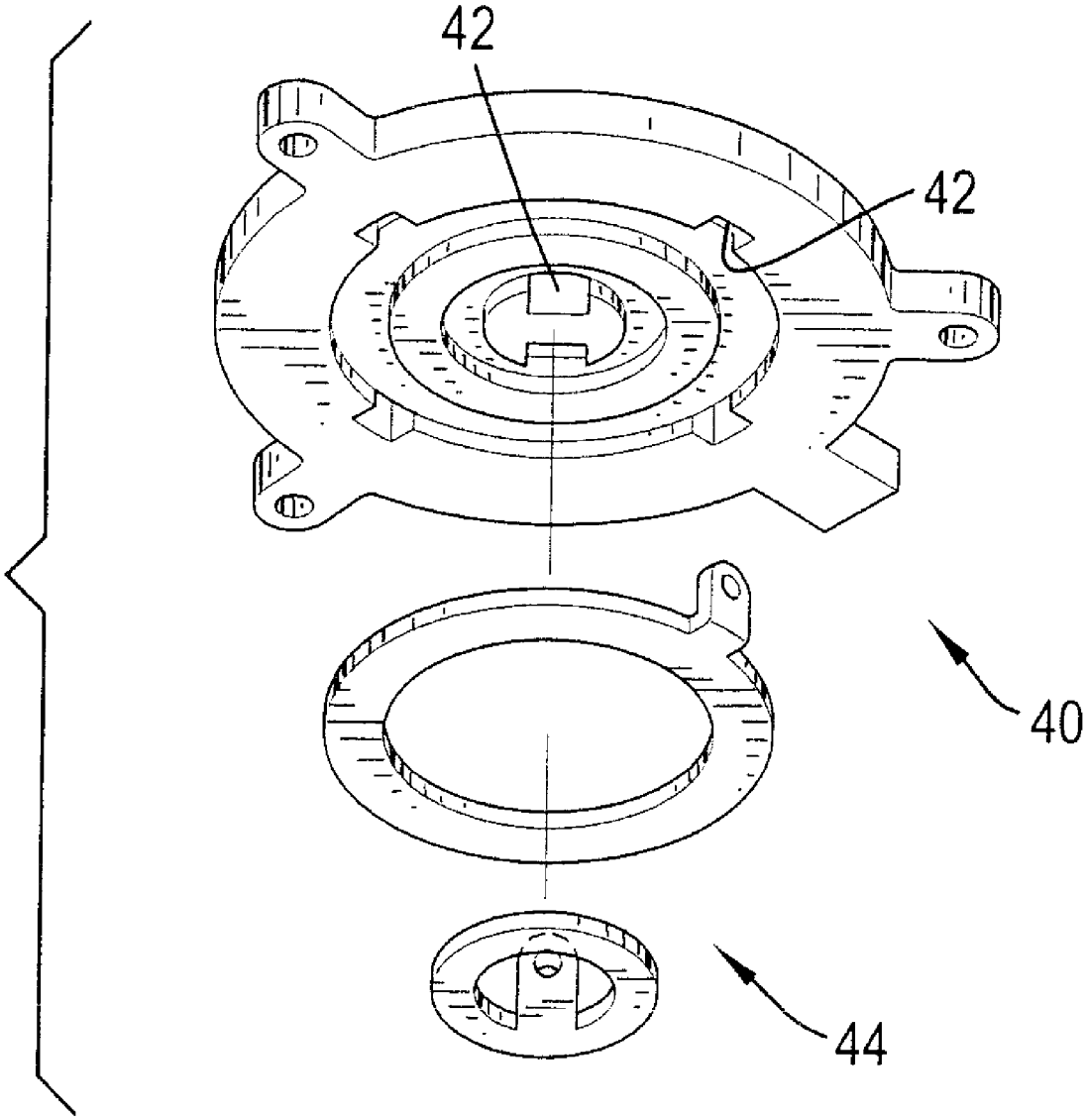
FIG. 4 is an exploded perspective view of a limit cover of the rotatable electric plug in FIG. 1.

With reference to FIG. 4, the two conducting members (44) are respectively mounted on the limit cover (40) and are shaped as circles corresponding to the passing routes of the distal contact ends of the contact arms (242). The conducting members (44) are respectively continuously contact with the distal contact ends of the contact arms (242) under a rotation of the rotatable brace (20) in the tube (12) after the limit cover (40) is mounted on the top end of the tube (12). The circuit board (50) is a printed circuit board (PCB), corresponds to and is mounted in the opening of the bottom case (10) and has two circuit board holes (52) that are formed through the circuit board (50) and are respectively aligned with the two connecting holes (42). The circuit board holes (52) allow wires extending therethrough for electronically connecting with the conducting members (44). The wires may be connected with two conducting pins that are respectively mounted through the two circuit board holes (52) and are electronically contacted with the conducting members (44) or may be respectively connected with the conducting members (44) via the circuit board holes (52) and the connecting holes (42).

The top cover (60) is mounted on the bottom case (10) to close the opening of the bottom case (10) and hold the rotatable brace (20), the limit cover (40) and the circuit board (50) between the bottom case (10) and the top cover (60).

When using, a person may select and mount a suitable plug head (30) on the bottom case (10) thereby connecting with the rotatable brace (20), such that this provides an ease assembling method to change the plug head (30). Furthermore, to resolve a problem of interference caused by multiple plugs being inserted into multiple adjacent sockets, the top cover (60) and the bottom case (10) can be rotated and positioned relative to the rotatable brace (20) and the plug head (30) to any desired angle.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A rotatable electric plug comprising:

a bottom case having
- a bottom surface;
- a top surface;
- an opening being formed through the top surface of the bottom case; and
- a tube being hollow, being formed through the bottom surface of the bottom case and having
  - a top end;
  - a lower end protruding from the bottom surface of the bottom case; and
  - an inner surface;

a rotatable brace being rotatably mounted in the inner surface of the tube, being positioned in the tube and having
- a brace body having a shape corresponding to and being movably surrounded by the inner surface of the tube and having a brace annular surface;
- a stand being formed on the brace body and having
  - a top end;
  - a bottom end being formed through the brace body;
  - a mounting hole being coaxially formed in the stand from the top end through the bottom end; and
  - a top surface having two contact holes being formed in the top surface and communicating with the mounting hole of the stand;
  - two connectors being electronically conductible, being respectively and separately mounted on the top surface of the stand and corresponding to the two contact holes of the top surface of the stand, each connector having
    - a contact arm being electronically conductible, protruding from the connector radially toward the brace annular surface of the brace body and having a distal contact end, where the two contact arms of the two connectors have different lengths to each other; and
    - a connecting pin being electronically conductible, protruding from one of the connectors, being mounted through one of the contact holes and being placed inside the mounting holes;

a plug head being detachably and rotatably mounted on the lower end of the tube and having
- an extending tube having a shape corresponding to and being detachably mounted in the mounting hole of the stand and having two plug holes, the plug holes being longitudinally and separately formed through the extending tube, being respectively aligned with the two contact holes of the stand and each plug hole having an electronically conductible inner surface detachably mounting on one of the connecting pins; and
- two plug pins being electronically conductible, being respectively mounted in the plug holes and being respectively and electronically connected to the two electronically conductible inner surfaces of the plug holes;

a limit cover having a shape corresponding to and being mounted on the top end of the tube to limit the rotatable brace inside the tube, the limit cover having
- two connecting holes, the connecting holes being respectively formed through the limit cover and aligned respectively with the two connectors; and two conducting members being respectively mounted on the limit cover and being shaped as circles having different radiuses and being respectively deposited corresponding and continuously contacted with to the distal contact ends of the contact arms; and a top cover being mounted on the bottom case to close the opening of the bottom case.

2. The rotatable electric plug as claimed in claim 1, wherein the tube has a mount recess being formed in the inner surface of the tube;

a positioning assembly being mounted in the mount recess and having a resilient element being mounted in the mount recess; and a positioning element being mounted in the mount recess, abutting against with the resilient element and protruding from the inner surface; and the rotatable brace has an positioning ring being circularly mounted on the brace annular surface of the brace body, being positioned corresponding to the mount recess and having an annular surface and multiple positioning recesses being formed in the annular surface of the positioning ring, and the positioning recesses selectively engaging the positioning element.

3. The rotatable electric plug as claimed in claim 2, wherein the rotatable electric plug further has a circuit board corresponding to and being mounted in the opening of the bottom case and having two circuit board holes being formed through the circuit board and being respectively aligned with the two connecting holes.

4. The rotatable electric plug as claimed in claim 3, wherein the two conducting members are respectively mounted in the connecting holes and respectively electrically contact to the connectors.

5. The rotatable electric plug as claimed in claim 3, wherein the inner surface of the tube has an annular flange formed thereon adjacent to the lower end of the tube; and the rotatable brace is supported in the tube by the annular flange.

6. The rotatable electric plug as claimed in claim 2, wherein the inner surface of the tube has an annular flange formed adjacent to the lower end of the tube; and the rotatable brace is positioned in the tube on the annular flange.

7. The rotatable electric plug as claimed in claim 1, wherein the rotatable electric plug further has a circuit board corresponding to and being mounted in the opening of the bottom case and having two circuit board holes being formed through the circuit board and being respectively aligned with the two connecting holes.

8. The rotatable electric plug as claimed in claim 7, wherein the two conducting members are respectively mounted in the connecting holes and respectively electrically contact to the connectors.

9. The rotatable electric plug as claimed in claim 7, wherein the inner surface of the tube has an annular flange formed thereon adjacent to the lower end of the tube; and the rotatable brace is supported in the tube by the annular flange.

10. The rotatable electric plug as claimed in claim 1, wherein the inner surface of the tube has an annular flange formed adjacent to the lower end of the tube; and the rotatable brace is positioned in the tube on the annular flange.

* * * * *